United States Patent [19]

Husted

[11] 4,183,368

[45] Jan. 15, 1980

[54] EAVE TROUGH FLUSHING SYSTEM

[76] Inventor: Gary V. Husted, 835 E. Main St., East Aurora, N.Y. 14052

[21] Appl. No.: 921,058

[22] Filed: Jun. 30, 1978

[51] Int. Cl.[2] ..... B08B 3/02; B08B 9/00

[52] U.S. Cl. ..... 134/166 R; 134/198; 52/16

[58] Field of Search ..... 134/166 R, 166 C, 167 R, 134/167 C, 168 R, 168 C, 172, 198; 52/16

[56] References Cited

U.S. PATENT DOCUMENTS

| | | | |
|---|---|---|---|
| 2,523,435 | 9/1950 | Jones | 52/16 |
| 2,710,616 | 6/1955 | Tydings | 134/167 R |
| 2,887,073 | 5/1959 | Thompson | 52/16 |
| 3,041,655 | 7/1962 | Entler | 134/167 R X |
| 4,117,635 | 10/1978 | Nelson | 52/16 X |

*Primary Examiner*—Robert L. Bleutge
*Attorney, Agent, or Firm*—Bean, Kauffman & Bean

[57] ABSTRACT

An eave trough (2) flushing system (1) is proposed which includes a nozzle mounting bracket (3) for mounting a nozzle (27) in a position to inject water into and lengthwise along an eave trough (2). The mounting bracket (5) laterally spans the eave trough (2) and is configured to engage the eave trough (2) in a manner that permits easy installation.

15 Claims, 6 Drawing Figures

EAVE TROUGH FLUSHING SYSTEM

TECHNICAL FIELD OF THE INVENTION

The present invention relates to cleaning devices for cleaning eave troughs of accummulated debris and/or snow or ice. More specifically, the invention is directed to a nozzle and a nozzle mounting bracket as parts of a system which includes a fluid delivery tube installed on the side of the building and which is adapted to be connected to a pressurized fluid source. Accordingly, the general objects of the present invention are to provide novel and improved apparatus of such character.

BACKGROUND OF THE INVENTION

Installation of a gutter or eave trough system at the lowermost edge of a sloping roof in order to collect and carry away rain water has been a common and long standing practice. Such a system can be expected to operate effectively and efficiently so long as the eave trough is kept clear of accumulations of snow, ice and debris such as leaves and twigs. It has been the experience of homeowners and other individuals responsible for building maintainance however, that eave troughs tend to accummulate material which, if not removed periodically, tends to obstruct and block the eave trough itself as well as the downspout which is intended to carry the rain water away. Additionally, it is frequently the circumstance that such debris is washed down the downspout and plugs the downspout or, in those cases in which the system is connected to an underground storm sewer, clogs the underground system. Accordingly, it is the adopted practice of many individual homeowners and building maintenance men to undertake the arduous, messy and sometimes dangerous task of cleaning debris out of eave troughs one or more times a year.

U.S. Pat. No. 2,887,073 issued May 19, 1959 entitled Self-Cleaning Gutter and Downspout Attachment to Collect Debris directs itself to this problem by proposing a gutter having a water carrying pipe with spaced orifices therealong immediately adjacent to or within the eave trough. This pipe may be used to provide a flow of water which is intended to aid in cleaning the eave trough of debris. The proposed system, however, has a number of disadvantages which are not easily surmounted within the context of the disclosure of the patent. One disadvantage is that the system requires the difficult and dangerous installation of a lengthy gutter containing a pipe or other fluid conduit in a not readily accessible location. Indeed, this disadvantage looms so large as to discourage all but the most enterprising homeowner from installing such a system.

A second disadvantage of the system proposed in the above referenced patent lies in the fact that the spaced orifices along the horizontal pipe act merely to squirt water into the eave trough at right angles to the length of the eave trough so that no advantage is gained from the velocity of injection. The injected water, when directed at the bottom of the eave trough, may be effective to agitate and loosen collected debris, but movement of the debris along the length of the eave trough to the downspout is restricted to the gentle gravitationally induced flow which results from the slight pitch of the eave trough. In many circumstances, this gravitationally induced flow is not adequate to move any debris except that which is lighter than water and which can float along the length of the eave trough. Accordingly, materials such as sand or grit which washes off of many types of roofing shingles as well as gravel which may have washed off an industrial roof remain and accummulate in a flow obstructing manner in the eave trough. A third disadvantage is the difficulty inherent in the installation of such a system which requires adjacent sections of gutter to include fluid tight coupling of the associated lengths of pipe or fluid conduit. Finally, the system disclosed in the prior patent is not one which involves the simple modification of pre-existing gutters but is one which requires disassembly and removal of the previous gutter with the substitution, at great expense, of the patented system.

Thus it can be seen that a need exists for a flushing system which may be safely and easily and inexpensively installed by an inexperienced homeowner and which has the capability of propelling debris, both lighter and heavier than water, along the length of the eave trough so that an efficient, effective, and complete gutter cleaning operation can be accomplished. The invention of the present application is such a system and cures the defects of the above cited patent.

THE INVENTION

To overcome the deficiencies and disadvantages of the prior art techniques, according to a preferred embodiment of this invention there is provided an eave trough flushing system, which, when properly installed produces a forceable flow of cleaning fluid within and along the length of a section of eave trough to a downspout. The system includes a nozzle mounted by a nozzle mounting bracket which engages and laterally spans the eave trough and which holds the nozzle in a position for injecting the cleaning fluid into and lengthwise along the trough. The nozzle is fluidically connected to a fluid conduit which runs down the side of a building and which is adapted to be connected to a fluid source for delivering a pressurized cleaning fluid, such as hot or cold water, up the side of the building and down through the nozzle into the trough. The bracket mounting the nozzle includes a first end adapted to extend over and partially down the back of the eave trough and a second end configured to extend over and partially down and under the front side of the eave trough in a manner which prevents movement of the bracket when the bracket properly engages the trough.

The first and second above mentioned ends are carried by first and second bracket portions which are adjustable relative to one another to provide a bracket which may be adjusted to fit a variety of eave troughs of different widths. The first end of the first portion is profiled to have an inverted U section and an upright V section: the combination of which permits the first end to extend over and behind the back of the eave trough and down and under a weatherproof flashing. The second end carried by the second portion of the bracket includes a vertically downwardly extending member and an inwardly extending member whereby the bracket fits under the outer overhanging contour of the eave trough.

In a preferred embodiment, the second portion of the bracket includes an integrally formed fluid conduit, one end of which extends partially into the eave trough and which is adapted to mate with an L or T-shaped nozzle. The other end includes a connector which may be connected to a fluid carrying tube which runs the vertical extent of the house. The fluid conduit itself is configured to have a self-draining inverted U-shape.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE BEST KNOWN MODE OF THE INVENTION

Figure 3:
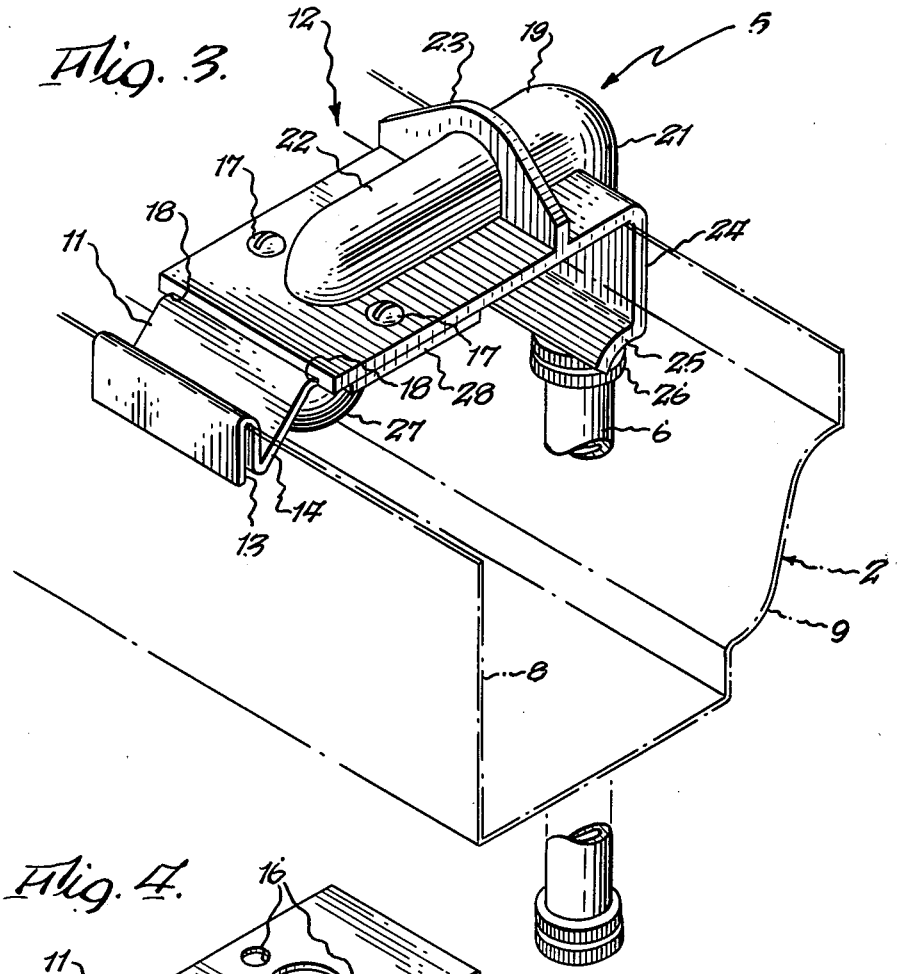
FIG. 3 is a perspective view of the nozzle mounting bracket of the present invention.
Figure 4:
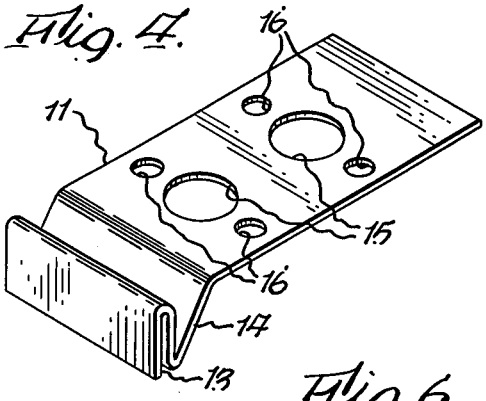
FIG. 4 is a perspective view of one portion of the nozzle mounting bracket of the present invention.

While the invention is susceptible of various modifications and alternative constructions, there is shown in the drawings and there will hereinafter be described, in detail, a description of the preferred or best known mode of the invention. It is to be understood, however, that the specific description and drawings are not intended to limit the invention to the specific form disclosed. On the contrary, it is intended that the scope of this patent include all modifications and alternative constructions thereof falling within the spirit and scope of the invention as expressed in the appended claims to the full range of their equivalents.

Figure 1:
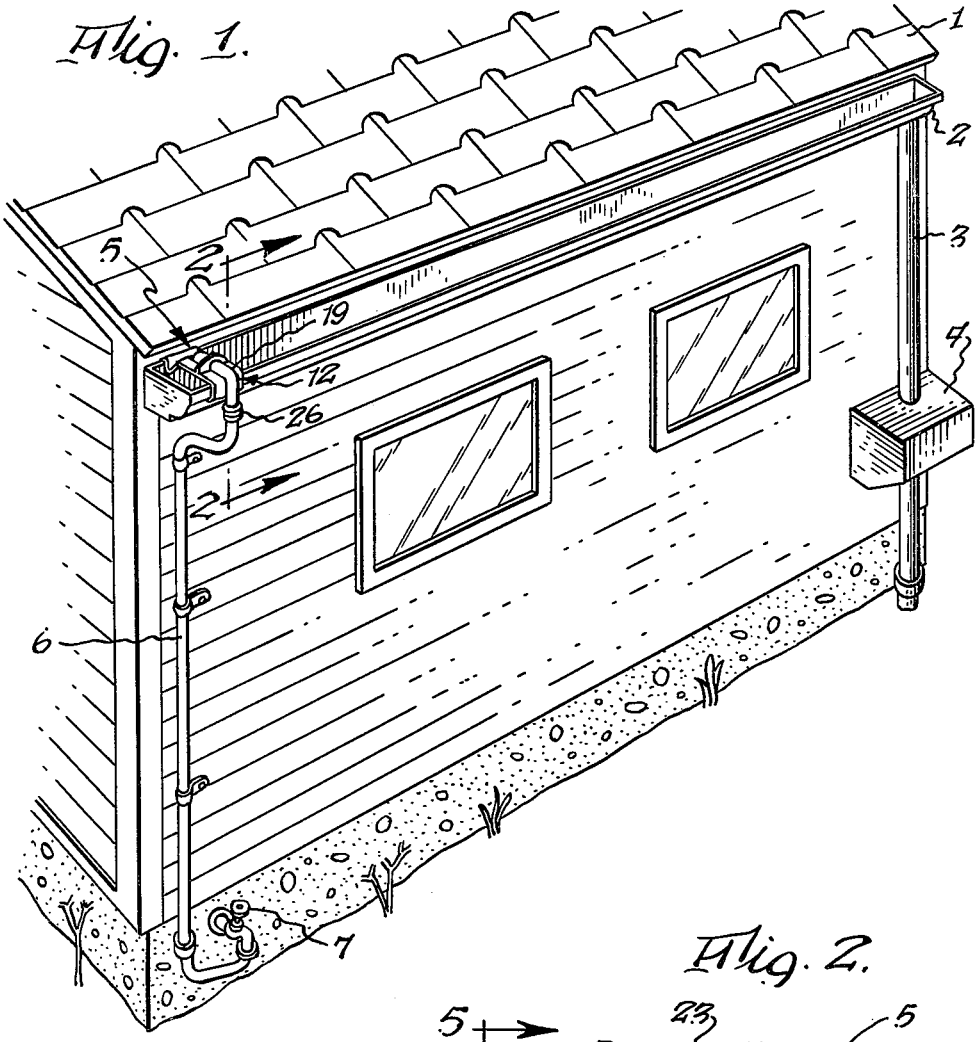
FIG. 1 illustrates a building with an eave trough and a flushing system as contemplated by the invention.

Referring now to FIG. 1, the flushing system is generally shown as applied to a building 1 having an eave trough or gutter 2 which is drained by a downspout 3. Downspout 3 is shown to empty into a strainer box 4 which strains out debris such as leaves and sticks prior to discharge of the fluid into an underground storm sewer, cistern or drainage field. At the end of the eave trough opposite to downspout 3, there is shown mounted on gutter mounting bracket 5 which mounts a nozzle in a position to direct a flushing or cleaning fluid into and lengthwise along the gutter 2. While FIG. 1 shows an end mounting position, it will be apparent that an intermediate position may be utilized with a T-nozzle to flush the eave trough in both the opposite directions if downspouts were located at both opposite ends. The nozzle is connected by way of fluid conduit 19, fluid connector 26, and fluid conducting hose 6 to an outside water tap 7 or some other source of pressurized fluid such as hot water. Desireably, hose 6 consists of two parts: a first part fixed to the building and terminating at the bottom of its vertical drop, and a second part which connects the first part to the water tap. In this manner, the second part of hose 6 can be disconnected both from the water tap and from the vertical portion and removed so that the vertical portion can be drained completely of water so that freezing of the water on the interior of the hose 6 does not present a problem.

Figure 2:
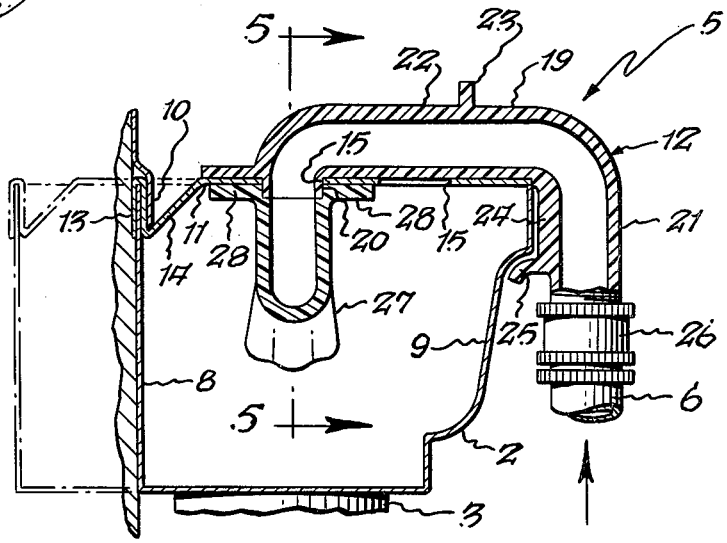
FIG. 2 is a cross-sectional view of a portion of the system shown in FIG. 1 taken along view lines 2—2.

Turning now to FIGS. 2 and 3, the bracket portion 5 of the invention is more explicitely set forth to comprise a first portion 11 and a second portion 12. First and second portions 11 and 12 are fastened together by screw or other fastening means 7. Removal of screw 7 permits first and second portions 11 and 12 to be moved relative to one another to provide at least a second adjusted position as shown in phantom in FIG. 2. The adjustability of the width of bracket 5 permits the bracket to be universally adaptable to all standard sized eave troughs or gutters 2.

As can be seen from FIG. 2, the gutter or eave trough 2 includes a back wall 8 and a sculptured front wall 9. Conventional construction of buildings with eave troughs includes a weatherproof flashing member 10 fastened to the wall of the building above the eave trough and extending down into the interior of the eave trough immediately adjacent to the back wall 8 of gutter 2. Accordingly, the end of first portion 11 of bracket 5 is configured to include an inverted U-section 13 which allows the bracket to extend up, over, and down behind the back wall 8. The first portion 11 also includes a V-shaped section 14 which is connected to the inverted U-shape section 13 at an elevation lower than the cross-over arch of the inverted U and which permits the end of the bracket to extend under the downwardly projecting flashing 10 without interferring with the weatherproofing function of the flashing.

Figure 6:
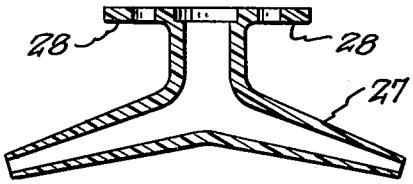
FIG. 6 is a cross-sectional representation of a second embodiment of the nozzle of the present invention.
Figure 5:
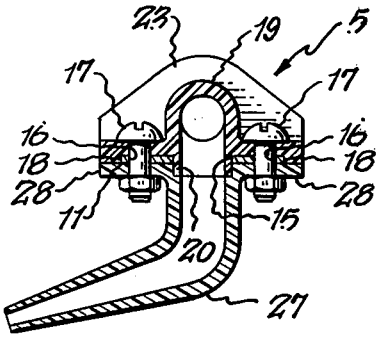
FIG. 5 is a second cross-sectional view of the bracket and nozzle of the present invention taken along the view lines 5—5 of FIG. 2.

In a preferred embodiment, the second portion 12 of bracket 5 is formed of molded plastic or other suitable material and includes an integrally formed, inverted U-shaped fluid conduit 19. Conduit 19 includes a horizontal portion 22 and a pair of downwardly extending stub portions 20 and 21. Stub 20 is adapted to mate with a nozzle 27; two varieties of which are shown in FIGS. 5 and 6. Nozzle 27 and downwardly pointing stub 20 may be adapted to mate with one another in any one of a number of common techniques; the one shown being a friction fit which permits L-shaped nozzle 27, shown in FIG. 5, having mounting flanges 28 to be bolted or otherwise fastened to second portion 12 to be able to point in either direction along the eave trough. Reversal of nozzle 27 enables the installation of the flushing system at either the right hand or the left hand end of the eave trough. The nozzle 27 shown in FIG. 6 has a T-shape which permits the injection of water into the gutter in both of two opposite directions when the flushing system is mounted in the center of the trough midway between two opposite downspouts.

As best seen in FIG. 2, one end of second portion 12 of bracket 5 includes a downwardly extending member 24 and an inwardly extending member 25 which are adapted to fit under and into the outer overhanging sculptured contour of the eave trough. This arrangement prevents vertical movement of bracket 5 so that when the bracket is affixed to the trough, the bracket resists being blown off by even the most powerful gusts of wind. As will be appreciated, the physical connection established by connector 26 between fluid conduit 19 and hose 6 also tends to tie the gutter bracket 5 down in the event of strong winds.

As previously described, portions 11 and 12 may be adjusted relative to one another to vary the width of the bracket so as to accommodate eave troughs of differing standard widths. In the preferred embodiment of the invention, portion 11 is received within a recess 18 formed in portion 12 as seen in either FIG. 3 or FIG. 5. The U-shaped conduit 19 of portion 12 is such that stub 20 penetrates down through recess 18. A plurality of appropriately sized apertures 15 are formed in first portion 11 to permit the passage of stub 20 alternatively therethrough. The cooperation between stub 20 and one of the plurality of aperatures 15 serves to determine an equal plurality of different standard widths of bracket 5 to correspond at least to the standard 4 and 5 inch widths of commonly available eave troughs 2. Additionally, a pair of holes 16 are also provided in first portion 11 for screws 17 which penetrate through second portion 12 and into one of the aligned holes 16.

One additional desirable feature of bracket 5 is seen in FIGS. 2, 3 and 5 and consists of a baffle plate 23 which extends upwardly from the upper surface of second portion 12. Baffle plate 23 prevents water from flowing off of the roof and onto the top surface of second portion 12 and then over the side of the eave trough without entering the eave trough itself.

Installation of the gutter flushing system as described hereinabove is easily accomplished as follows. First, first and second portions 11 and 12 are separated by the removal of screw 17. Flashing 10, if any, is lifted to a degree which permits U-shaped clip section 13 to be slid over and behind the back wall 8 of the eave trough. Flashing 10 is then bent down into approximately its original position within the V-shaped section 14 of the first portion 11. Next, member 25 of second portion 12 is engaged with the overhanging contour of the eave trough 2 while in a slightly tilted position. Second portion 12 is then rotated toward a horizontal position as stub 20 is guided into one of the apertures 15 of portion 11 to seat portion 11 in the recess 18 of second portion 12. When appropriately seated, screw 17 is inserted and screwed into engagement with one of the holes 16 to fasten the first and second portions 11 and 12 securely together. Next, either the L-shaped nozzle 27 shown in FIG. 5 or the T-shaped nozzle 27 shown in FIG. 6 is pushed into engagement with stub 20 and fastened to face in the direction best suited for discharging pressurized water down the length of the eave trough. Finally, conduit portion 21 is connected with hose 6 by connector 26 to which is then fastened to the side of the building. As can be seen, installation requires minimum effort with the handling of only small, light and easily maneuvered components at the elevation of the eave trough. Furthermore, the ability of the present system to move heavier than water particles greatly exceeds that of the previously known system due to the pressurized injection of the cleansing water into and along the length of the eave trough.

What is claimed is:

1. An apparatus for causing cleaning fluid to be forceably injected into and lengthwise along an eave trough of a building, said apparatus adapted to be mounted on an eave trough having one of a plurality of standard widths and characterized by including:

a. a nozzle for forceably directing cleaning fluid; and b. a nozzle mounting bracket including first and second portions telescopically adjustable relative to one another for laterally spanning said eave trough and means for firmly clamping said first and second portions together in an adjusted configuration consistant with the width of said eave trough, said first portion including an inverted U profile end adapted to extend over and partially down the back of said eave trough, said second portion including a body with a fluid conduit having a first end adapted to mate with said nozzle and a second end adapted to be connected to a fluid source, said conduit having the form of and inverted U so as to be self-draining, said second portion further including a vertically downwardly extending member and an inwardly extending member adapted to fit under the outer overhanging contour of said eave trough to prevent vertical movement of said bracket when engaged with said eave trough.

2. The eave trough cleaning apparatus as recited in claim 1 characterized in that said nozzle is adapted to be fastened to said second portion in one of two oppositely facing directions.

3. The eave trough cleaning apparatus as recited in claim 1 characterized in that said first end of said fluid conduit projects vertically into the top of said eave trough and said nozzle has an L-shape.

4. The eave trough cleaning apparatus as recited in claim 1 characterized in that said first end of said fluid conduit projects vertically into the top of said eave trough and said nozzle has a T-shape.

5. The eave trough cleaning apparatus as recited in claim 4 characterized in that said first portion includes a plate with a plurality of apertures adapted to receive therethrough said first end of said fluid conduit, each aperture establishing a different telescopically adjusted position.

6. The eave trough cleaning apparatus as recited in claim 1 characterized in that said second portion includes an upwardly extending baffle or impeding the flow of water over the top surface of said second portion.

7. The eave trough cleaning apparatus as recited in claim 1 characterized in that said first portion is formed of a rectangular plate and said second portion includes a recess having a width at least equal to the width of said plate for receiving therein said first portion.

8. The eave trough cleaning apparatus as recited in claim 1 characterized in that said fluid conduit is an integral part of said second portion.

9. The eave trough cleaning apparatus as recited in claim 1 characterized by further including a fluid conducting flexible tube fluidically connected to said second end of said fluid conduit, said tube being affixed to and running down the side of said building.

10. An eave trough flushing system for providing a forceable flow of cleaning fluid along the length of a section of eave trough to the downspout, the system characterized by:

a. a nozzle for directing a pressurized cleaning fluid into and lengthwise along an eave trough;

b. a fluid conduit fluidically connected to said nozzle at one end and running down the side of the building, the opposite end of which being adapted to be connected to a fluid source; and c. bracket means adapted to be attached to said eave trough in a trough spanning attitude for mounting said nozzle in a position for injecting said cleaning fluid into and lengthwise along said eave trough, said bracket means including a first end adapted to extend over and partially down the back of the eave trough and a second end adapted to extend over and partially down the front of said eave trough, said second end including a vertically downwardly extending member and an inwardly extending member whereby said bracket fits under the outer overhanging contour of said eave trough in a manner which prevents vertical movement when engaged with said eave trough.

11. The eave trough flushing system as recited in claim 10 characterized in that said first end has an inverted U profile with a downwardly extending free leg and a leg attached to said bracket at an elevation below the cross-over portion of said inverted U, whereby said first end is adapted to extend over and partially down the back of said eave trough without interferring with a weatherproofing flashing attached to said building and extending partially into the interior of said eave trough.

12. The eave trough flushing system as recited in claim 11 characterized in that said bracket means is adjustable to vary the separation between said first and second ends in order to accommodate a variety of eave troughs having different widths, said bracket means including first and second portions carrying said first and second ends respectively, said first and second portions being telescopically adjustable relative to one another.

13. The eave trough flushing system as recited in claim 12 characterized in that said bracket is adapted to hold said nozzle in a substantially horizontal attitude but with a slight downward inclination.

14. A rain gutter bracket for mounting a nozzle thereon in an attitude which permits a cleaning fluid to be forceably injected into and lengthwise along said rain gutter by said nozzle for flushing said gutter of accummulated ice and/or debris; said gutter bracket characterized by:

a. a first platelike portion having an aperture therethrough and formed at one end to include an inverted U adapted to extend up and over and partially down behind the back wall of said rain gutter and a V-like depression adapted to extend under any weatherproof flashing which may extend slightly into said gutter adjacent to its back wall;

b. a second portion having a recess for receiving therewithin said first platelike portion, said second portion including an integrally formed fluid conduit having an inverted U-shape with first and second downwardly extending ends, said first end extending down through the center of said recess and having a size adapted to fit through said aperture of said first member, said first end also being adapted to mate with and support said nozzle, said second end extending downwardly at a position exterior to said rain gutter and terminating in a fluid connector adapted to be connected to a fluid source, said second portion also including means for engaging the front exterior of said rain gutter in a manner which prevents vertical movement of said bracket, said means including a downwardly and inwardly extending member adapted to engage the outer overhanging contour of said rain gutter; and c. means for attaching said first and second members together to provide said bracket with one of a plurality of different lengths consistent with the width of said gutter.

15. The rain gutter bracket as recited in claim 14 characterized in that said second portion includes a baffle member on its upper side for impeding the flow of water thereacross.

* * * * *